US008205807B2

(12) United States Patent
Ballu

(10) Patent No.: US 8,205,807 B2
(45) Date of Patent: Jun. 26, 2012

(54) AUTOMATIC ATOMIZING SPRAY GUN

(75) Inventor: Patrick Ballu, Reims (FR)

(73) Assignee: Exel Industries, Epernay (FR)

( * ) Notice: Subject to any disclaimer, the term of this patent is extended or adjusted under 35 U.S.C. 154(b) by 391 days.

(21) Appl. No.: 12/307,231

(22) PCT Filed: Jun. 29, 2007

(86) PCT No.: PCT/FR2007/001112

§ 371 (c)(1),
(2), (4) Date: Dec. 31, 2008

(87) PCT Pub. No.: WO2008/003850

PCT Pub. Date: Feb. 10, 2008

(65) Prior Publication Data

US 2009/0283610 A1 Nov. 19, 2009

(30) Foreign Application Priority Data

Jul. 3, 2006 (FR) ..... 06 06007

(51) Int. Cl.

| | |
|---|---|
| ***B05B 1/28*** | (2006.01) |
| ***B05B 7/12*** | (2006.01) |
| ***B05B 7/06*** | (2006.01) |
| ***B05B 1/30*** | (2006.01) |

(52) U.S. Cl. ..... 239/296; 239/291; 239/292; 239/294; 239/300; 239/417.3; 239/424; 239/585.5

(58) Field of Classification Search ..... 239/296, 239/290, 291, 292, 294, 297, 299, 300, 398, 239/401, 416.5, 417.3, 418, 421, 423, 424, 239/569, 583, 585.5

See application file for complete search history.

(56) References Cited

U.S. PATENT DOCUMENTS

| | | | | |
|---|---|---|---|---|
| 5,190,219 | A * | 3/1993 | Copp, Jr. | 239/296 |
| 6,264,113 | B1 * | 7/2001 | Dingler | 239/8 |
| 6,378,783 | B1 * | 4/2002 | Ballu | 239/290 |
| 7,661,606 | B2 * | 2/2010 | Vacher | 239/296 |
| 2002/0000452 | A1 * | 1/2002 | Iizuka et al. | 222/190 |
| 2002/0018856 | A1 * | 2/2002 | Kufner et al. | 427/421 |
| 2005/0098654 | A1 * | 5/2005 | Reetz, III | 239/296 |
| 2005/0098655 | A1 * | 5/2005 | Reetz, III | 239/296 |
| 2006/0097070 | A1 * | 5/2006 | Huffman | 239/290 |
| 2008/0023000 | A1 * | 1/2008 | Fenn et al. | 128/200.23 |

FOREIGN PATENT DOCUMENTS

| | | | |
|---|---|---|---|
| EP | 1063018 | | 12/2000 |
| EP | 1063018 | A1 * | 12/2000 |
| FR | 2863512 | | 6/2005 |
| FR | 2863512 | A1 * | 6/2005 |

OTHER PUBLICATIONS

International search report in corresponding PCT/FR2007/001112.

* cited by examiner

*Primary Examiner* — Jason J Boeckmann
*Assistant Examiner* — Steven M Cernoch
(74) *Attorney, Agent, or Firm* — Young & Thompson

(57) ABSTRACT

An automatic spray gun includes a nozzle (4) for ejecting the product that is to be sprayed, controlled by a needle valve (9), and means (14, 10) for controlling the movement of the needle (9). A tabular elastic sealing means (13) surrounds the needle valve (9) and is mounted trapped between the front (1*a*) and rear (1*b*) parts of the body. The interior surface of the tabular means (13) is tailored to the diameters of the needle valve (9) and of a control slide (14) mounted on the needle valve in order to move the needle thereof.

5 Claims, 1 Drawing Sheet

AUTOMATIC ATOMIZING SPRAY GUN

BACKGROUND OF THE INVENTION

The invention relates to an automatic spray gun for atomizing a product such as an abrasive paint, a lacquer, or an enamel, which is water-soluble or dissolved in a solvent.

The invention is especially useful for high-pressure and high-frequency atomization of paints that can be cross-linked by ultraviolet radiation.

This type of automatic spray gun comprises a pressurized propellant gas chamber supplied with pressurized propellant gas, generally compressed air, and a product chamber that is supplied with the product to be atomized under pressure.

A nozzle for atomization of the product to be atomized under pressure is connected to the product chamber. The product is supplied upstream from the spray gun and emerges through a calibrated opening of the nozzle.

Moreover, within the spray gun, there is a slide that passes through the gas and product chambers and that is provided on its front end with a needle valve that can block said nozzle.

The opening of the needle is triggered by the action of the propellant gas, generally compressed air.

On its back end, the slide is made integral with the actuating means, generally a pneumatic cylinder that can move in translation to block or clear said nozzle. The pneumatic cylinder comprises a piston returned to the closed position by a spring and moved into the open position by the propellant gas.

To prevent the propellant gas from travelling from the gas chamber to the product chamber along the slide and conversely to prevent the product to be atomized from travelling from the product chamber to the gas chamber, there are sealed oscillating means crossed by said slide.

During atomization of the product, the propellant gas, intended for atomization, facilitates atomization of the product through the central opening of the nozzle and forms a concentrically oriented jet formed by peripheral air vents.

In such a known automatic spray gun, said slide slides each time that it is necessary to open and close the nozzle.

In the known manner, there is an offset for opening the atomization air before discharge of the product and for ensuring the blocking of the nozzle before the closing of the atomization air.

On the nozzle side, the surface of the slide is in contact with the product that is to be atomized and that is often abrasive and/or corrosive, as is the case, for example, for enamel.

The sealing means can be static or deformable: the static means can be O-ring seals, scraper seals, or catches similar to braces, whereas the deformable means can comprise a bellows, a membrane or other flexible surface mounted between a fixed part and a movable part of the spray gun.

Document FR 2 863 512 thus describes an automatic atomizing spray gun comprising a flexible bellows on the side of the chamber of the product to be atomized. This flexible bellows is attached to the body of the spray gun on its back end and comprises a movable front end that forms a seal around the needle.

The needle comprises a shoulder that works with the seal formed by the front end of the bellows.

The spray gun of document FR 2 863 512, however, comprises a bellows with coils, of which the surface is difficult to rinse and clean, in particular in the depressions and corners between the coils.

Document EP1063018 likewise discloses an automatic spray gun with a membrane in which the needle valve is integral with the membrane and crosses it, in such a manner as to be connected to a pulsation control element.

However, due to the significant surface area of the membrane in contact with the product, the membrane must be protected by a coating, for example by a polytetrafluoroethylene layer.

SUMMARY OF THE INVENTION

A first objective of the invention is to improve the known prior art by providing a new automatic spray gun for atomizing a product such as an abrasive paint, a lacquer, or an enamel, which is water-soluble or dissolved in a solvent and which is easy to rinse and clean.

A second objective of the invention is to provide a new automatic spray gun for atomizing a product such as an abrasive paint, a lacquer, or an enamel, which is water-soluble or dissolved in a solvent, in which the sealed oscillating means have a small surface area in contact with the product to be atomized.

A third objective of the invention is to provide a new automatic spray gun for atomizing a product such as an abrasive paint, a lacquer, or an enamel, which is water-soluble or dissolved in a solvent, in which a protective coating of the sealed oscillating means is no longer necessary.

The object of the invention is an automatic spray gun for atomizing a product such as an abrasive paint, a lacquer, or an enamel, which is water-soluble or dissolved in a solvent, comprising a body having a front part that defines a chamber of the product to be atomized, and a back part for control and admission of a propellant gas, an atomization head and a nozzle that discharges the product controlled by a movable needle valve, as well as means for controlling the movement of the needle valve, an elastic sealing means surrounding the needle valve between the product to be atomized and the propellant gas while being mounted clamped between the front and back parts of the body, characterized by the fact that the elastic sealing means has an elongated tubular shape whose inner surface is adjusted to the diameters of the needle valve and a control slide mounted on the needle valve for moving it, so as to withstand the pressure of the product to be atomized.

According to other alternative characteristics of the invention:

The elastic sealing means is fixed on its front end so as to be locked against a shoulder of the needle valve and to prestress the elastic sealing means in compression.

The elastic means is mounted clamped against one part by screwing of a cylindrical jacket.

The cylindrical jacket for clamping the elastic sealing means defines the chamber of the product to be atomized.

The elastic sealing means has an external shape that is continuously concave in contact with the product to be atomized.

The travel of the needle valve is short, roughly several millimeters, and the variation of the radial dimensions of the elastic sealing means is small, roughly several tenths of a millimeter.

The elastic sealing means has a sleeve shape, with a front part bulging radially inwards and a back part bulging radially outwards.

The elastic sealing means is made of a perfluorinated elastomer material.

Control means work with a mechanical offset corresponding to a clearance and ensuring the opening of the propellant gas before the opening of the product to be atomized and the closing of the product to be atomized before the closing of the propellant gas.

BRIEF DESCRIPTION OF THE DRAWINGS

The invention will be better understood by the following description given by way of a nonlimiting example with reference to the attached drawings in which.

DETAILED DESCRIPTION OF THE PREFERRED EMBODIMENTS

Figure 1:
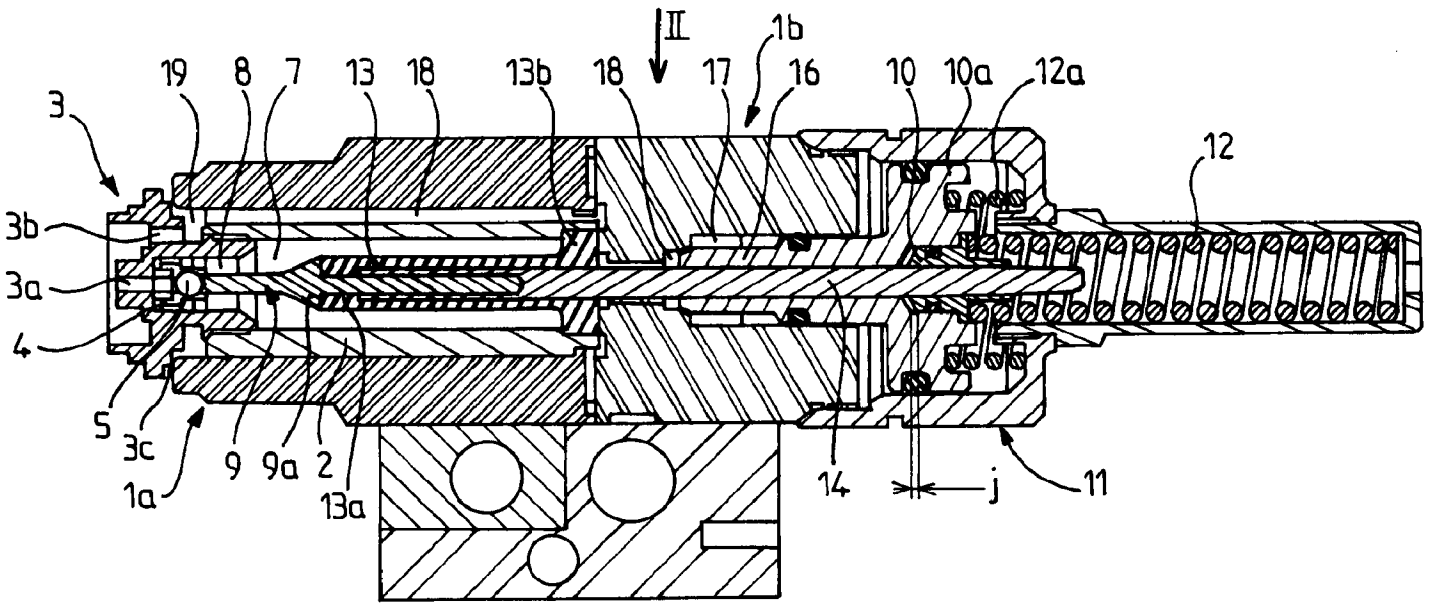
FIG. 1 schematically shows a longitudinal cutaway view in the direction of line II-II of FIG. 2 of an automatic spray gun according to the invention.
Figure 2:
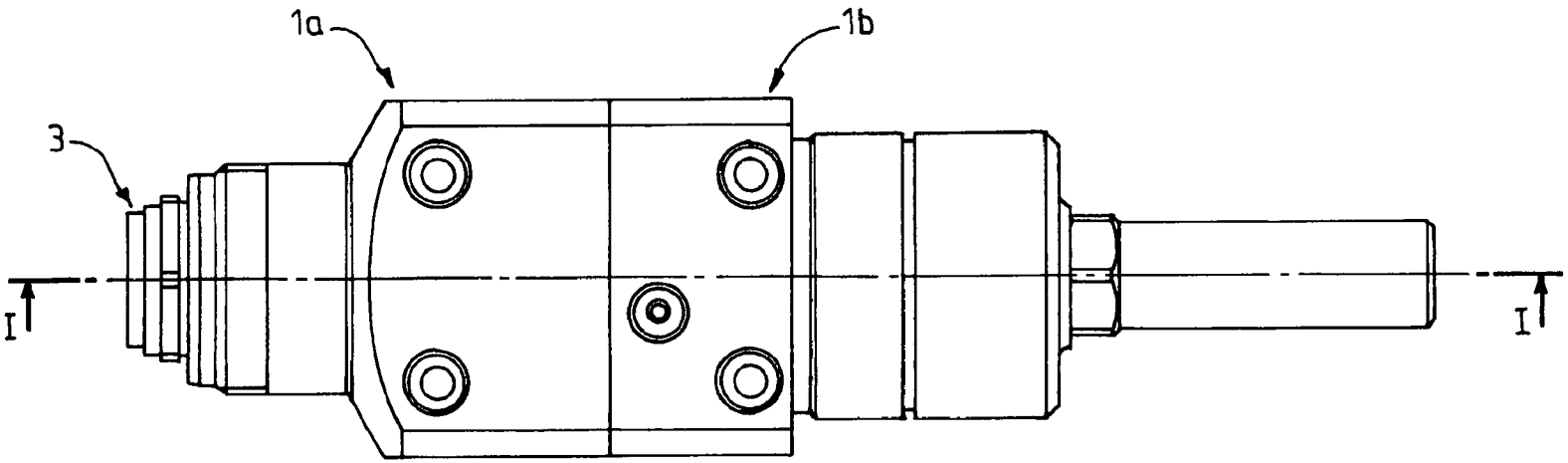
FIG. 2 schematically shows a top view in the direction of arrow I of FIG. 1 of an automatic spray gun according to the invention.

With reference to FIG. 1, an automatic spray gun according to the invention comprises a front part 1*a* and a back part 1*b*, of which at least one, 1*a* or 1*b*, is made of lightweight metal.

The front part 1*a* contains a cylindrical jacket 2 made of material that is resistant to abrasion, for example stainless steel, which accommodates an atomization head 3 by screwing it in.

The atomization head 3 comprises a central opening 3*a* and several peripheral openings 3*b* or 3*c*. Based on the product discharge opening 3*a* and the propellant gas exit openings 3*b* or 3*c*, atomization of the product is obtained by atomization of the product supplied to the spray gun under constant pressure, in combination with feed of atomization air that, besides atomization, makes it possible to control the shape and/or the dimensions of the jet of atomized product.

The atomizing spray gun according to the invention comprises atomization air feed means that discharge in the vicinity of the atomization nozzle 4 to improve atomization and to form the product jet.

The atomization air is supplied independently of the product exit using a mechanical offset that supplies the atomization air in an annular chamber formed in the atomization head and that communicates with the first set of openings 3*b* or air nozzles discharging quite near the exit 3*a* of the nozzle 4 and with a second set of openings 3*c* located in a ring located on the front end of the body of the spray gun. This arrangement allows the openings of this second set of openings 3*c* to point the atomization air jets at a much greater angle toward the product jet emerging from the nozzle 4.

The nozzle 4 is shaped as a ball valve 5 comprising a module that can be interchanged by screwing it into the cylindrical jacket 2.

The product to be atomized is supplied under constant pressure by a pipe to the feed chamber 7 of the product delivered to the front part of the spray gun, with an essentially cylindrical ring shape, discharging directly into a central channel 8 of the atomization head 3 that connects the feed chamber 7 of the product to an atomization nozzle 4.

To control the feed of the product to the nozzle 4 and especially to cut off this feed when the spray gun is no longer actuated, the automatic spray gun according to the invention uses a needle valve 9 that blocks the exit of the product through the nozzle 4.

The return of the needle valve 9 to clear this exit is controlled by pneumatic control means that act on the piston 10 of a cylinder 11 moving the needle valve 9 to the rear. When the pneumatic control means are no longer actuated, a return spring 12 acts on the piston 10 in the opposite direction to move the needle 9 forward to close the exit of the product.

When the piston 10 is pushed back by a control air pulsation to the rear, compressing the spring 12 up to its back position, the end of the needle valve 9 releases the ball 5 and clears access to the atomization nozzle 4 for the pressurized product that travels from the product input chamber 7 to the nozzle 4 through the annular space defined between the internal wall of the central channel 8 and the external surface of the needle valve 9.

To improve atomization and to better shape the jet of atomized product that is emerging from the atomization nozzle 4, the spray gun is likewise provided with atomization air feed means that discharge near the atomization nozzle 4. These atomization air feed means comprise a compressed air pipe connected to an air duct discharging into an air input chamber 17 that is circular overall and that is arranged around a valve 16 in the back part 1*b* of the body of the spray gun. This air input chamber 17 is connected to an external circular chamber 19 arranged in the atomization head 3 via successive communicating annular passages 18 that extend into the back part 1*b* and front part 1*a* of the body. This external chamber 19 is in communication with the atmosphere through the openings 3*b* or 3*c* discharging on the front surface of the atomization head 4.

The control piston 10 of the needle valve 9 is surrounded by a piston 10*a* that is coaxial to the piston 10 and is prestressed into the position closed by a spring 12*a*.

The front end of the piston 10*a* narrows to form a poppet valve 16 applied to a seat, formed in or integral with the back part 1*b*, by the pressure of a spring 12*a*.

There is a predetermined play j of the displacement between the piston 10 and the piston 10*a* such that the movement of the piston 10 is controlled in both directions with an offset by movement of the piston 10*a*, for both opening and closing.

The connection between the needle valve 9 and the piston 10 is ensured by a connecting slide 14 that traverses the front part 1*a* and back part 1*b* of the body of the spray gun.

The slide 14 is shaped as a pin threaded on its front end on the needle valve 9 and is made integral on its back end with the piston 10 and a support plate of the spring 12.

The slide 14 is mounted on the needle valve 9 so as to clamp a front shape 13*a* of an elastic sealing element 13 against a shoulder 9*a* of the needle valve 9 and to prestress the sealing element 13 in compression.

The back end 13*b* of the elastic sealing element 13 is clamped between the front part 1*a* or its jacket 2 made of stainless steel and the back part 1*b* of the body of the spray gun to ensure interlocking and static sealing.

Due to the elasticity of the sealing element 13, elongation and shortening of the element 13 can be done at increased actuating frequencies, around 2 Hz, while ensuring a service life of 10 million cycles at increased pressures of roughly 120 bar.

Advantageously, the elastic sealing element 13 has an elongated tubular shape, of which the inside surface is adjusted to the diameters of the needle valve and the slide, so as to withstand the pressure applied by the product to be atomized on the external surface of the element 13.

Preferably, the elongated sealing element 13 is made in the form of a tubular sleeve with two bulging ends 13*a*, 13*b*.

The front end 13*a* is bulging radially inwards, whereas the back end 13*b* is bulging radially outwards.

Due to the fact that the action of the needle 9 is to keep the ball 5 in contact with its seat or to allow its separation, the travel of the needle 9 is small, roughly two millimeters.

The variation of radial dimensions is again smaller, roughly a tenth of a millimeter; this allows use at increased actuating frequencies, roughly 2 Hz.

The continuously concave shape of the external surface of the sealing element 13 facilitates rinsing and cleaning of this external surface and eliminates the difficulties of rinsing and cleaning that are encountered with the bellows and membranes of the prior art.

The essentially cylindrical shape of the outside surface of the sleeve 13 likewise makes it possible to reduce the surface area in contact with the product to be atomized by comparison with the bellows and membranes of the prior art.

The material used for making the sleeve 13 can be a polyurethane in the case of a specification of resistance to water-soluble products.

Polyurethanes are economical and easy to shape, preferably by molding, or if necessary by machining.

In the case of resistance to all types of products to be atomized, water-soluble or dissolved in a solvent, the sleeve 13 can be made of a perfluorinated elastomer material with high chemical inertia.

A perfluorinated elastomer that is used is a perfluorinated elastomer specially formulated for a high-pressure environment and explosive decompressive conditions, which is satisfactory.

The invention is not limited to the described embodiment, but on the contrary covers any modification of shape and any variant embodiment within the framework and the spirit of the invention.

Thus, the material used for the sleeve 13 can be modified without departing from the scope of this invention and if necessary can be composed of a metallic or nonmetallic material.

The invention claimed is:

1. An automatic spray gun for atomizing a product that is water-soluble or dissolved in a solvent, comprising:

a body having a front part containing a chamber for the product to be atomized, and a back part for control and admission of a propellant gas;

a cylindrical jacket, made of material resistant to abrasion, contained in said front part, said chamber for the product to be atomized being in an interior of the cylindrical jacket;

an atomization head and a nozzle for discharge of the product controlled by a movable needle valve;

means for controlling movement of the needle; and an elastic sealing means surrounding the needle valve and having an elongated tubular shape with an inner surface matched to a diameter of the needle, the elastic sealing means clamped against the back part of the body by the cylindrical jacket via a screwing engagement, the elastic sealing means so clamped being mounted between the front part and back part of the body, said inner surface being further matched to a diameter of a control slide, mounted on the needle valve for moving the needle valve, so that said elastic sealing means withstands a pressure of the product to be atomized, wherein a front end of the elastic sealing means is fixed so as to lock the elastic sealing means against a shoulder of the needle valve and to prestress the elastic sealing means in compression.

2. The automatic spray gun according to claim 1, wherein the elastic sealing means has an external shape that is continuous and configured to be in contact with the product to be atomized.

3. The automatic spray gun according to claim 1, wherein the elastic sealing means has a sleeve shape, with a front part bulging radially inwards and a back part (1b) bulging radially outwards.

4. The automatic spray gun according to claim 1, wherein the elastic sealing means is made of a perfluorinated elastomer material.

5. The automatic spray gun according to claim 1, wherein the control means work with a mechanical offset corresponding to a clearance and ensuring the opening of the propellant gas before the opening of the product to be atomized and closing of the product to be atomized before the closing of the propellant gas.

* * * * *